US005784044A

United States Patent [19]

Matsushiba

[11] Patent Number: 5,784,044

[45] Date of Patent: Jul. 21, 1998

[54] IMAGE DISPLAY METHOD AND CIRCUIT

[75] Inventor: Takuji Matsushiba, Ebina, Japan

[73] Assignee: International Business Machines Corporation, Armonk, N.Y.

[21] Appl. No.: 533,470

[22] Filed: Sep. 25, 1995

[30] Foreign Application Priority Data

Sep. 26, 1994 [JP] Japan ..... 6-229380

[51] Int. Cl.[6] ..... G09G 5/00

[52] U.S. Cl. ..... 345/113; 345/99; 345/115

[58] Field of Search ..... 345/99, 114, 115, 345/116, 150, 113, 213; 348/584–586, 588–589

[56] References Cited

U.S. PATENT DOCUMENTS

| | | | |
|---|---|---|---|
| 4,951,145 | 8/1990 | Snashall et al. | 345/113 |
| 4,954,970 | 9/1990 | Walker et al. | 345/113 |
| 5,450,097 | 9/1995 | Takebe | 345/113 |
| 5,532,714 | 7/1996 | Knapp et al. | 345/114 |
| 5,579,027 | 11/1996 | Sakurai et al. | 345/99 |
| 5,610,621 | 3/1997 | Itoh et al. | 345/99 |
| 5,619,225 | 4/1997 | Hashimoto | 345/99 |

*Primary Examiner*—Richard A. Hjerpe
*Assistant Examiner*—Mahmoud Fatahiyar
*Attorney, Agent, or Firm*—Scully, Scott, Murphy and Presser

[57] ABSTRACT

The present invention concerns an image display method and an image display circuit for superimposing digital video data on external digital video data. An object of the invention is to provide an image display method and a display circuit through which color bleeding and image flickering are not generated on an image-generated based on the external digital video data when the digital video data is superimposed on the external digital video data. A comparison shift clock whose phase is led from that of a dot clock is generated and external digital video data is latched thereby. A comparison shift clock whose phase is delayed from that of the dot clock is formed and the external digital video data is latched thereby. The respective values latched by the dot clock and the comparison shift clocks are compared with one another. If the respective values do not coincide with one another, external digital video data in which the position of the change point of the data is shifted is generated.

9 Claims, 3 Drawing Sheets

IMAGE DISPLAY METHOD AND CIRCUIT

FIELD OF THE INVENTION

The present invention relates to an image display method and an image display circuit for superimposing digital video data on external video data.

BACKGROUND ART

Recently, display devices designed to display picture images by using digital video signals have assumed a typical form such as a liquid crystal display (LCD) which has been actively developed in place of the cathode ray tube (CRT) for displaying picture images based on analog video signals. The LCD which is used for a display device of a personal computer (PC) has been so employed, for example.

The display of an image by using a digital video signal (data) is carried out in such a manner that digital display data stored in a VRAM in a PC is synchronization with horizontal and vertical synchronizing signals as well as a dot clock and the display data synchronized therewith is output to an LCD based on the control of a video controller. For example, in the case of a color LCD of an active matrix drive system in which a thin-film transistor (TFT) is used as a switching element, as for digital video data from the PC, the data with the number of bits composed of three or more bits is received for each of three primary colors comprising red (R), green (G), and blue (B). The TFT/LCD supplies a gradation voltage corresponding to the value of the digital video data to the data line (drain electrode) of the corresponding picture element so that an image on an image plane (one frame) is displayed by sequentially scanning gate lines.

Recently, an idea has been proposed that an image generated by an external image generation circuit and the like is superimposed on this digital video data and the video data superimposed on the image is displayed on an LCD. For example, as shown in FIG. 6, it is assumed that a plurality of windows 104 is opened and displayed on the front surface of a background (what is sometimes called a wallpaper) 102 in the display area 100 of the LCD. At this time, if an operator desires to change, for example, the display brightness or display contrast of the LCD, it will be convenient to display a display adjustment image 106 such as "BRIGHTNESS 50%," "CONTRAST 80%." Thus, an attempt such that, for example, a display adjustment image generated in an external image generation circuit is superimposed on an image displayed based on digital video data from the PC and the thus superimposed image is displayed, has been made.

The image display circuit which has been proposed will be described below with reference to FIG. 3. FIG. 3 illustrates a circuit corresponding to one bit of digital video data which is composed of three primary colors having R, G, and B respectively comprising a plurality of bits. Accordingly, although, as the entire body of the image display circuit, there actually exists the circuits shown in FIG. 3 with the number which corresponds to the number of bits of X data of the three primary colors having R, G, and B, the illustration of the entire circuit body is omitted.

The proposed image display circuit is first provided with, for example, a data latch circuit 2 such as a D flip-flop which latches and outputs digital video data by taking the rise time of a dot clock with a clock width of 10 nanoseconds (ns) as a sampling timing. The output of the data latch circuit 2 is connected to a data superimposition processing circuit 8.

Similarly, there is provided an external digital video data generation circuit 4 for generating a display adjustment image at the time of the rise of the dot clock. The output of the external digital video data generation circuit is connected to an external data latch circuit 6 to latch and output the display adjusting image at the time of the rise of the dot clock. The output of the external data latch circuit 6 is connected to the data superimposition processing circuit 8.

In the data superimposition processing circuit 8, the digital video data is superimposed on the display adjustment image and the superimposed data is output to an LCD through a latch circuit 10.

According to this image display circuit, the digital video data and the generated display adjustment image are latched based on the dot clock and the latched digital video data is superimposed on the latched display adjustment image and the thus superimposed data is output to the LCD.

However, when the image data actually superimposed by using the above stated image display circuit was observed, it was found that problems such as those shown in FIG. 4 arose.

Specifically stated, FIGS. 4 (*a*) and 4 (*b*) both show that, for example, an elongated and rectangular vertical rod 116 (an area surrounded by a solid line) which constitute s a part of a character is to be displayed with a white color on a background 102 of a black color by using the above described image display circuit. However, as illustrated in FIG. 4 (*a*), a problem arises such that, for example, an area 114 of a red color was observed in an area surrounded by vertical broken lines at the right side of the figure, an area 112 of blue and green colors was observed in an area surrounded by vertical broken lines at the left side of the figure, and color bleeding was seen in the longitudinal direction of the periphery of the adjustment character.

FIG. 4 (*b*) shows an image to be displayed in a certain frame. Broken lines 116 indicate a state in which a superimposed image shifts by one dot rightward. Since the misregistration of the image shown by the broken lines 116 changes for each single frame, the periphery of the adjustment character appears to be flickering. These, however, are only exemplifications. Color bleeding or flickering of the adjustment character occurs generated in different types of variation besides those illustrated, which results in the degradation of the quality of the image on the LCD.

Such color bleeding or flickering is caused by the fact that a sampling point at the time of the rise of a dot clock is located in the vicinity of a change point of external digital video data shown in FIG. 5 in the external data latch circuit 6 shown in FIG. 3. In an ordinary video processing LSI, the range of the inhibition of a change to prevent the change point of data from being included in the vicinity of the sampling point is set and the LSI is designed based thereon. For example, in the case in which an external digital video data generation circuit 4 for generating a display adjustment image of the LCD is added, a delay time is generated in the external digital video data generation circuit 4 from the input of the dot clock to the output of data. The delay time generated in the external digital video data generation circuit 4 changes depending on the unevenness in parts of the LCD in question and the change in temperature, etc. Therefore, when the data is latched by the external data latch circuit 6, a problem arises such that the sampling point is included in the range of inhibition of the change of the data, so that prescribed data can be obtained or cannot be obtained. That is, as illustrated in FIG. 5, there occurs a state in which the data of a prescribed dot is sampled or the data of one dot before (or one dot after) the prescribed dot is sampled.

In such a case, the external digital video data of a dot one dot before (or one dot after) a prescribed dot is superimposed on digital video data input based on a prescribed dot clock in the data superimposition processing circuit 8. Briefly stated, the data to be superimposed one upon another is shifted by one dot and superimposed, so that bleeding in an image due to a color misregistration arises as shown in FIG. 4 (*a*). Since the value of data to be sampled at the change point of data is indefinite for each horizontal line or each frame of the LCD, flickering such as that shown in FIG. 4 (*b*) appears in a display adjustment image.

SUMMARY OF THE INVENTION

An object of the present invention is to provide an image display method and an image display circuit in which color bleeding or flickering does not arise in an image formed based on external digital video data when digital video data is super imposed on the external digital video data.

In order to achieve the above described object, in an image display method according to the invention described in claim 1 in which digital video data is latched based on a reference clock, external digital video data is generated based on the reference clock, the external digital video data is latched based on the reference clock, and the latched digital video data is superimposed on the external digital video data to output the thus superimposed data, the image display method comprises the steps of: generating a first comparison shift clock whose phase is led from the reference clock and latching the external digital video data thereby; generating a second comparison shift clock whose phase is delayed from the reference clock and latching the external digital video data thereby; and comparing the respective values latched by the reference clock, the first and second comparison shift clocks, generating a shift clock in which the phase of the reference clock is shifted if the respective values do not coincide with one another, and generating the external digital video data in which the positions of change points of data are shifted based on the shift clock.

The invention described in claim 2 concerns an image display method in which digital video data is latched based on a reference clock, external digital video data is generated based on the reference clock, the external digital video data is latched based on the reference clock, and the latched digital video data is superimposed on the external digital video data to output the thus superimposed data. The image display method is characterized by comprising the steps of: generating a first comparison shift clock whose phase is led from the reference clock and latching the external digital video data thereby; generating a second comparison shift clock whose phase is delayed from the reference clock and latching the external digital video data thereby; and comparing the respective values latched by the reference clock, the first and second comparison shift clocks, shifting the positions of data change points of the external digital video data if the respective values do not coincide with one another, and then latching the external digital video data based on the reference clock.

The invention described in claim 3 concerns an image display method according to claim 1 or 2, wherein the amount of shift of the first and second reference clocks is located outside a range of the inhibition of data change of the reference clock input to an external data latch circuit and within a range of substantially 20% of the period of the reference clock.

The invention described in claim 4 concerns an image display method according to any of claims 1 to 3, wherein the amount of shift of the position of the data change point of the external digital video data is substantially 50% of the period of the reference clock.

The invention described in claim 5 concerns an image display circuit including a data latch circuit for latching and outputting digital video data based on a reference clock, an external digital video data generation circuit for generating and outputting external digital video data based on the reference clock, an external data latch circuit for latching and outputting the external digital video data based on the reference clock and a data superimposition processing circuit for superimposing the digital video data output by the data latch circuit on the external digital video data output by the external data latch circuit and outputting the superimposed data. The image display circuit is characterized by comprising: first and second comparison latch circuits to which the external digital video data is input, the first and second comparison latch circuits being provided in parallel with the external data latch circuit; a comparison clock shift circuit for inputting a first comparison shift clock in which a phase is led from the reference clock input to the external data latch circuit to the first comparison latch circuit and for inputting a second comparison shift clock in which a phase is delayed from the reference clock input to the external data latch circuit to the second comparison latch circuit; a clock shift circuit for outputting a shift clock formed by shifting the phase of the reference clock to the external digital video data generation circuit; and a comparison and control means for comparing the respective output values of the external data latch circuit and the first and second comparison latch circuits and controlling the clock shift circuit so that the phase of the shift clock is changed if the respective output values do not coincide with one another.

The invention described in claim 6 concerns an image display circuit including a data latch circuit for latching and outputting digital video data at the time of the rise or fall of a reference clock, an external digital video data generation circuit for forming and outputting the external digital video data at the time of the rise or fall of the reference clock, an external data latch circuit for latching and outputting the external digital video data at the time of the rise or fall of the reference clock and a data superimposition processing circuit for superimposing the digital video data output by the data latch circuit on the external digital video data output by the external data latch circuit and outputting the superimposed data. The image display circuit is characterized by comprising: first and second comparison latch circuits to which the external digital video data is input, the first and second comparison latch circuits being provided in parallel with the external data latch circuit; a comparison clock shift circuit for inputting a first comparison shift clock whose phase is led from that of the reference clock input to the external data latch circuit to the first comparison latch circuit and for inputting a second comparison shift clock whose phase is delayed from that of the reference clock input to the external data latch circuit to the second comparison latch circuit; a clock shift circuit for outputting a shift clock formed by shifting the phase of the reference clock to the external digital video data generation circuit; and a comparison and control means for comparing the respective output values of the external data latch circuit and the first and second comparison latch circuits and for controlling the clock shift circuit so that the phase of the shift clock is changed if the respective output values do not coincide with one another.

The invention described in claim 7 concerns an image display circuit according to claim 5 or 6, wherein, instead of the clock shift circuit for outputting the shift clock obtained by shifting the phase of the reference clock to the external digital video data generation circuit, a data shift circuit is provided for shifting the positions of data change points of the external digital video data input to the external data latch circuit and the first and second comparison latch circuits, and the comparison and control means compares the respective output values of the external data latch circuit and the first and second comparison latch circuits and controls the data shift circuit so that the positions of data change points of the external digital video data are shifted if the respective output values do not coincide with one another.

The invention described in claim 8 concerns an image display circuit according to any one of claims 5 to 7, wherein the amount of shift of the first and second comparison shift clocks input to the first and second comparison latch circuits is located outside a range of the inhibition of a data change of the reference clock input to the external data latch circuit and within a range of substantially 20% of a period of the reference clock.

The invention described in claim 9 concerns an image display circuit according to any one of claims 5 to 8, wherein the amount of shift of the positions of the data change points of the external digital video data is substantially 50% of a period of said reference clock.

According to the present invention, a first comparison shift clock whose phase is led from that of a reference clock is generated, and external digital video data is latched thereby. A second comparison shift clock whose phase is delayed from that of the reference clock is generated and external digital video data is latched thereby. Then, the respective values latched by the reference clock and by the first and second comparison shift clocks are compared. If the respective values do not coincide with one another, external digital video data in which the position of the change point of data is shifted is generated. Therefore, the data is not sampled within a range of the inhibition of change of the external digital video data. This can contribute to the execution of an image display without color bleeding or flickering.

DETAILED DESCRIPTION OF THE PREFERRED EMBODIMENT

Figure 1:
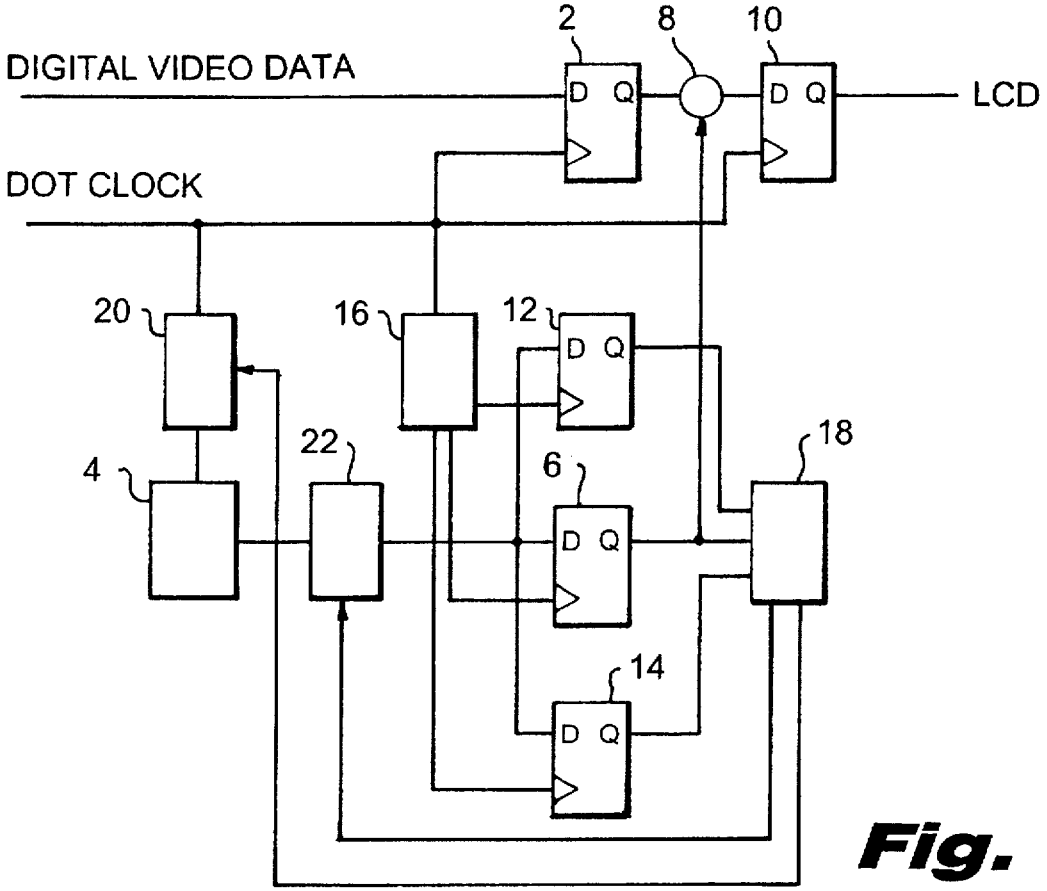
FIG. 1 is a view showing an image display circuit according to an embodiment of the present invention.
Figure 3:
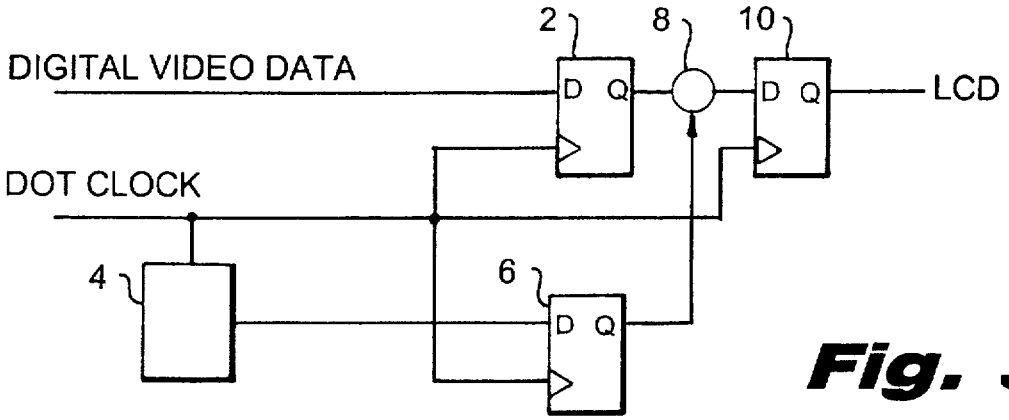
FIG. 3 is a view showing a proposed image display circuit.
Figure 2:
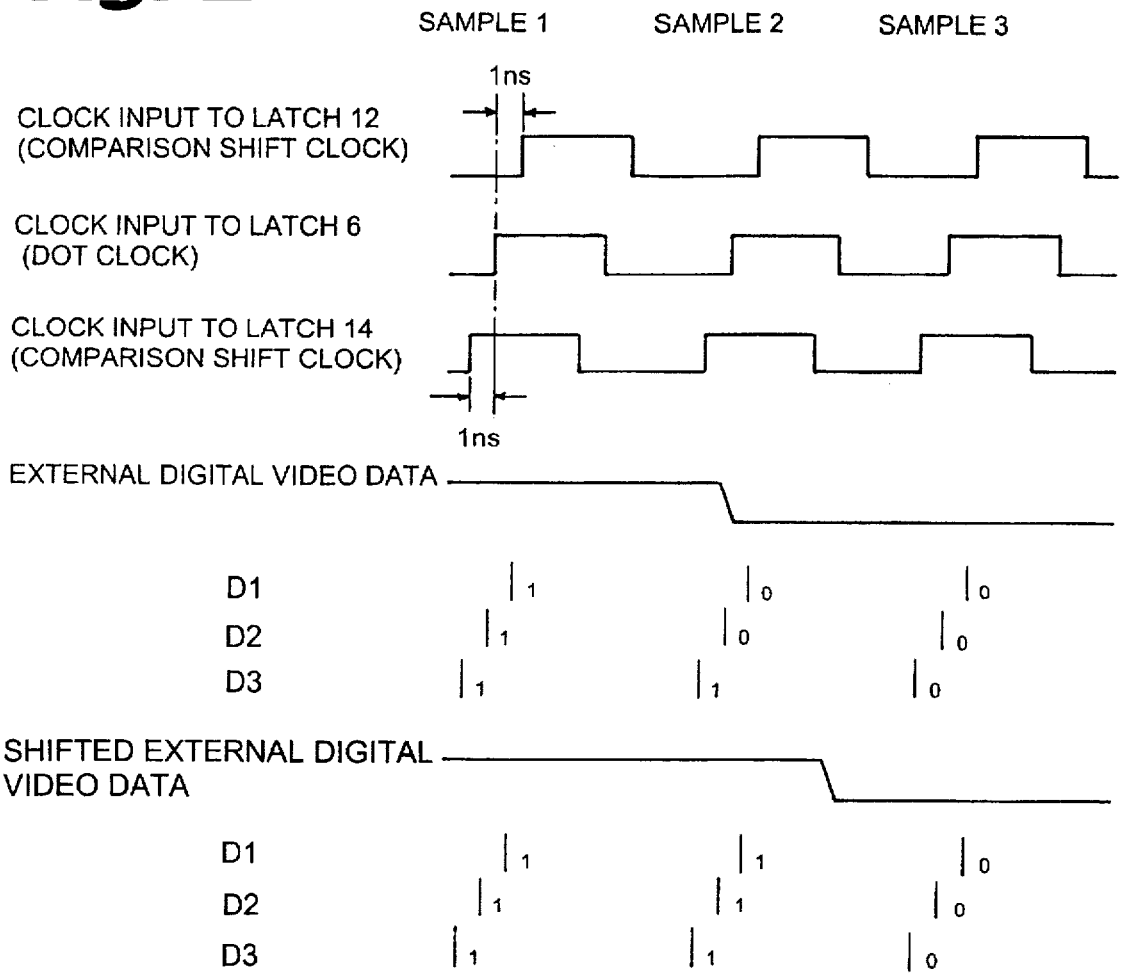
FIG. 2 is an explanatory view of an image display method according to an embodiment of the present invention.
Figure 4A:
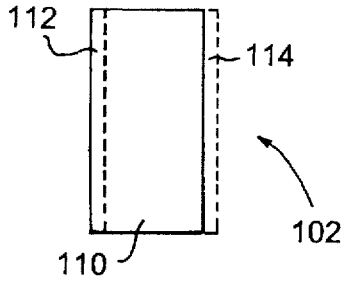
FIGS. 4(*a*) and 4(*b*) shows explanatory views of images displayed by the proposed image display circuit.
Figure 4B:
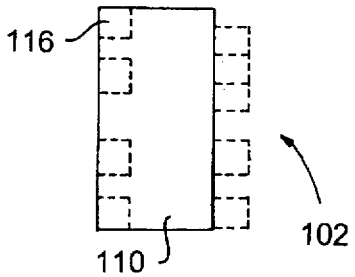
Figure 5:
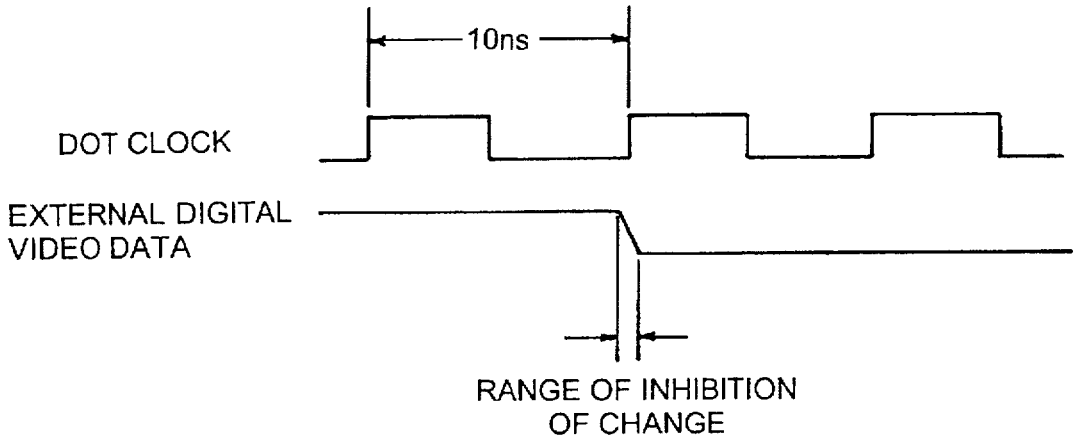
FIG. 5 is a view for explaining problems in the proposed image display circuit.
Figure 6:
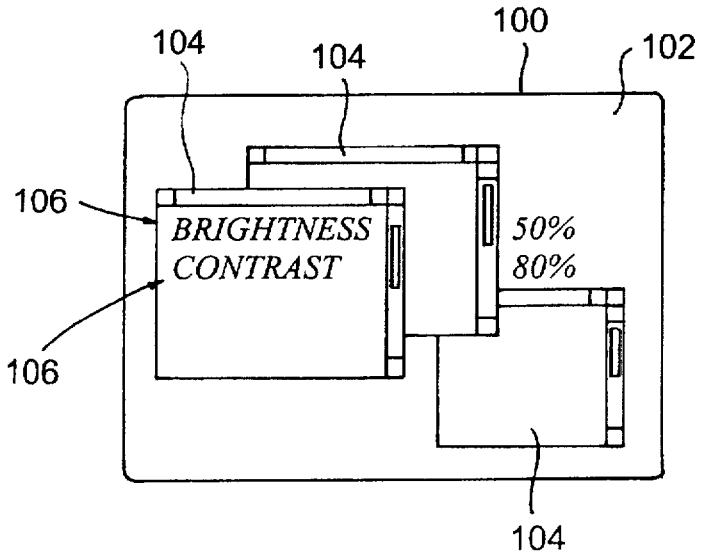
FIG. 6 is a view showing an LCD image plane on which a display adjustment image is superpimposed on digital video data and the supimposed data is displayed.

An image display method and an image display circuit according to an embodiment of the present invention will be described with reference to FIGS. 1 and 2.

Initially, referring to FIG. 1, the construction of an image display circuit according to the present embodiment will be described. FIG. 1 illustrates a circuit corresponding to one bit of digital video data consisting of the three primary colors comprising R, G, and B respectively composed of a plurality of bits. Accordingly, the entire construction of the image display circuit includes the number of circuits shown in FIG. 1 which corresponds to the number of bits of X data of the three primary colors of R, G, and B. However, the illustration of the entire circuit construction is omitted.

First, the rise of a dot clock with a clock width of, for example, 10 ns is taken as a sampling timing so that digital video data is latched and output, as for example, for a data latch circuit 2 which is a D flip-flop is formed. The output of the data latch circuit 2 is connected to a data superimposition processing circuit 8.

An external digital video data generation circuit 4 is provided for generating a display adjustment image of, for example, an LCD at the time of the rise of the dot clock. To the input part of the dot clock is connected a clock shift circuit 20 for outputting a shift clock formed by shifting the phase of the dot clock to the external digital video data generation circuit 4.

The output of the external digital video data generation circuit 4 is input to an external data latch circuit 6 and comparison latch circuits 12 and 14 respectively in parallel through a data shift circuit 22 for shifting the position of the data change points of external digital video data. The outputs of the external data latch circuit 6, and the comparison latch circuits 12 and 14 are connected to a controller 18 so that they are input thereto. Further, the output of the external data latch circuit 6 is connected to the data superimposition processing circuit 8.

The controller 18 is a comparison and control means for controlling the clock shift circuit 20 or the data shift circuit 22 which compares the output of the external data latch circuit 6 with the outputs of the comparison latch circuits 12 and 14 and shifts the change points of the external digital video data input to the external data latch circuit 6 and the comparison latch circuits 12 and 14.

Clocks are respectively input to the external data latch circuit 6 and the comparison latch circuits 12 and 14 by a comparison clock shift circuit 16. As the clocks output by the comparison clock shift circuit 16, a dot clock is input to the external data latch circuit 6, a clock delayed, for example, by 1 ns from the dot clock to the comparison latch circuit 12 and a clock led, for example, by 1 ns led from the dot clock to the comparison latch circuit 14.

In the data superimposition processing circuit 8, the digital video data is superimposed on the display adjustment image and the superimposed data is output to an LCD through a data latch circuit 10.

Next, the operation of the image display circuit will be described with reference to FIG. 2. The external digital video data output by the external digital video data generation circuit 4 i s respectively input in parallel to the external data latch circuit 6 and the comparison latch circuits 12 and 14 and respectively latched. The data is latched by the respective latch circuits at the time of the rise of clocks input to the respective latch circuits by the comparison clock shift circuit 16. The timing of the rise of the respective clocks is illustrated in FIG. 2. In the case of a shift clock which is input to the comparison latch circuit 12, the rise thereof occurs with the delay of about 1 ns from the rise of the dot clock which is input to the external data latch circuit 6. In the case of a shift clock which is input to the comparison latch circuit 14, the rise thereof occurs with the leading of about 1 ns from the rise of the dot clock which is input to the external data latch circuit 6.

The output values of the respective latch circuits 6, 12 and 14 are input to the controller 18 and the respective values are compared with one another. In FIG. 2, D1 designates an output value of the comparison latch circuit 12 input to the controller 18. Similarly, D2 shows an output value of the external data latch circuit 6 and D3 an output value of the comparison latch circuit 14.

For example, in the case of a sample 1, the values of D1 to D3 are all 1 (H). Accordingly, it is determined that, when the external digital video data is latched by the external data latch circuit 6, there is no change point of data.

Similarly, in the case of a sample 3, the values of D1 to D3 are all 0 (L). Consequently, it is determined that, when the external digital video data is latched by the external data latch circuit 6, there is no change point of data.

In the case of a sample 2, since D1 and D2 indicate 0 and D3 designates 1, it is determined that the data is latched by the external data latch circuit 6 in the change point of the external digital video data.

Since the range of the inhibition of change of the external digital video data is as small as 0.1 ns, it is preferably necessary that the amount of shift of the clocks input to the comparison latch circuits 12 and 14 be 1 ns.

In such a manner, it is possible to determine that the data is latched by the external data latch circuit 6 in the change point of the external digital video data except in a case in which all of the values of D1 to D3 coincide with one another.

When it is determined that the data is latched in the change point of data, the controller 18 controls either the clock shift circuit 20 or the data shift circuit 22 to shift the data change points of the external digital video data output to the latch circuits 6, 12, and 14 for approximately 50% of a period of the dot clock. In the present embodiment, the change point of the data is shifted so as to be delayed.

In this connection, since the period of the change point of the external digital video data is integer times as large as that of the dot clock, when the change point of the data at any sampling point is detected and the data is shifted, the sampling at the change points of the data can be avoided at all sampling points. Further, the image display circuit of the present embodiment can meet the superimposition for each bit of the digital video data composed of a plurality of bits for a gradation display. Therefore, in case of video data composed of four bits, 12 image display circuits for the three primary colors of R, G, and B are employed as a whole and the controller 18 is OR-connected. Thus, in a case where the change point of data is detected for any bit only once, the change points of the external digital video data of all bits can be simultaneously shifted by the same amount of shift. In addition, if the amount of shift of the data is generally controlled (adjusted) once by the controller 18, the bleeding and flickering of the external digital video data (for example a display adjustment image) appearing on all of the image planes of the LCD can be eliminated.

It should be understood that the invention is not limited to the above described embodiment, and that various types of alternative examples can be made.

For example, although, in the above-mentioned embodiment, the shift clock to be input to the comparison latch circuits 12 and 14 is designed to rise with the delay of about 1 ns (about 10% of a period of the dot clock) from the rise of the dot clock to be input to the external data latch circuit 6, or to rise with the leading of about 1 ns therefrom, it is to be appreciated that it is not limited thereto. The shift clock is preferably located outside a range of inhibition of change of the data of the dot clock in out to the external data latch circuit 6 and within approximately 20% of a period of the dot clock.

Additionally stated, although, in the above-mentioned embodiment, the change point of the data is shifted to be delayed, it is to be understood that it can be reversely shifted so as to be led.

Furthermore, while in the above-mentioned embodiment, the amount of shift of the data change point of the external digital video data is about 50% of a period of the dot clock, it is to be apparent that an arbitrary amount of shift can be set within an interval situated from the rise of the shift clock of the comparison latch circuit 12 to the next rise of the shift clock of the comparison latch circuit 14.

As described above, according to the present invention, an image display method and an image display circuit capable of eliminating the generation of color bleeding or image flickering of an image which is generated based on external digital video data when digital video data is superimposed on the external digital video data can be realized.

I claim:

1. An image display method in which digital video data is latched based on a reference clock, external digital video data is generated based on said reference clock, said external digital video data is latched based on said reference clock, and said latched digital video data is superimposed on said external digital video data to output the thus superimposed data, said image display method comprising the steps of:

generating a first comparison shift clock whose phase is led from said reference clock and latching said external digital data thereby;

generating a second comparison shift clock whose phase is delayed from said reference clock and latching said external digital video data thereby; and comparing respective values latched by said reference clock, the first and second comparison shift clocks, generating a shift clock in which the phase of said reference clock is shifted if the respective values do not coincide with one another, and generating said external digital video data in which the positions of change points of data are shifted based on said shift clock.

2. An image display method in which digital video data is latched based on a reference clock, external digital video data is generated based on said reference clock, said external digital video data is latched based on said reference clock, and said latched digital video data is superimposed on said external digital video data to output the thus superimposed data, said image display method comprising the steps of:

generating a first comparison shift clock whose phase is led from said reference clock and latching said external digital video data thereby;

generating a second comparison shift clock whose phase is delayed from said reference clock and latching said external digital video data thereby; and comparing respective values latched by said reference clock, the first and second comparison shift clocks, shifting the positions of data change points of said external digital video data if the respective values do not coincide with one another, and then latching said external digital video data based on said reference clock.

3. An image display method according to claim 1 wherein the amount of shift of said first and second reference clocks is located outside a range of the inhibition of data change of said reference clock input to an external data latch circuit and within a range of substantially 20% of the period of said reference clock.

4. An image display method according to claim 1, wherein the amount of shift of the position of the data change point of said external digital video data is substantially 50% of the period of said reference clock.

5. An image display circuit including a data latch circuit for latching and outputting digital video data based on a reference clock, an external digital video data generation circuit for generating and outputting external digital video data based on said reference clock, an external data latch circuit for latching and outputting said external digital video data based on said reference clock, and a data superimposition processing circuit for superimposing said digital video data output by said data latch circuit on said external digital video data output by said external data latch circuit and outputting the superimposed data, said image display circuit comprising:

first and second comparison latch circuits to which said external digital video data is input, said first and second comparison latch circuits being provided in parallel with said external data latch circuit;

a comparison clock shift circuit for inputting a first comparison shift clock in which a phase is led from said reference clock input to said external data latch circuit to said first comparison latch circuit and for inputting a second comparison shift clock in which a phase is delayed from said reference clock input to said external data latch circuit to said second comparison latch circuit;

a clock shift circuit for outputting a shift clock formed by shifting the phase of said reference clock to said external digital video data generation circuit; and a comparison and control means for comparing the respective output values of said external data latch circuit and said first and second comparison latch circuits and controlling said clock shift circuit so that the phase of said shift clock is changed if said respective output values do not coincide with one another.

6. An image display circuit including a data latch circuit for latching and outputting digital video data at the time of the rise or fall of a reference clock, an external digital video data generation circuit for forming and outputting said external digital video data at the time of the rise or fall of said reference clock, an external data latch circuit for latching and outputting said external digital video data at the time of the rise or fall of said reference clock and a data superimposition processing circuit for superimposing said digital video data output by said data latch circuit on said external digital video data output by said external data latch circuit and outputting the superimposed data, said image display circuit comprising:

first and second comparison latch circuits to which said external digital video data is input, said first and second comparison latch circuits being provided in parallel with said external data latch circuit;

a comparison clock shift circuit for inputting a first comparison shift clock whose phase is led from that of said reference clock input to said external data latch circuit to said first comparison latch circuit and for inputting a second comparison shift clock whose phase is delayed from that of said reference clock input to said external data latch circuit to said second comparison latch circuit;

a clock shift circuit for outputting a shift clock formed by shifting the phase of said reference clock to said external digital video data generation circuit; and a comparison and control means for comparing the respective output values of said external data latch circuit and said first and second comparison latch circuits and for controlling said clock shift circuit so that the phase of said shift clock is changed if said respective output values do not coincide with one another.

7. An image display circuit according to claim 5 wherein, instead of the clock shift circuit for outputting the shift clock obtained by shifting the phase of said reference clock to said external digital video data generation circuit, a data shift circuit is provided for shifting the positions of data change points of said external digital video data input to said external data latch circuit and said first and second comparison latch circuits, and said comparison and control means compares the respective output values of said external data latch circuit and said first and second comparison latch circuits and controls the data shift circuit so that the positions of data change points of said external digital video data are shifted if said respective output values do not coincide with one another.

8. An image display circuit according to any claim 5 wherein the amount of shift of said first and second comparison shift clocks input to said first and second comparison latch circuits is located outside a range of the inhibition of a data change of said reference clock input to said external data latch circuit and within a range of substantially 20% of a period of said reference clock.

9. An image display circuit according to claim 5 where in the amount of shift of the positions of the data change points of said external digital video data is substantially 50% of a period of said reference clock.

* * * * *